US009314847B2

(12) United States Patent
Konyashin et al.

(10) Patent No.: US 9,314,847 B2
(45) Date of Patent: Apr. 19, 2016

(54) CEMENTED CARBIDE MATERIAL

(71) Applicant: Element Six GmbH

(72) Inventors: Igor Yurievich Konyashin, Huenfeld (DE); Bernd Heinrich Ries, Huenfeld (DE); Frank Friedrich Lachmann, Burghaun (DE)

(73) Assignee: Element Six GmbH, Burghaun (DE)

( * ) Notice: Subject to any disclaimer, the term of this patent is extended or adjusted under 35 U.S.C. 154(b) by 74 days.

(21) Appl. No.: 14/475,465

(22) Filed: Sep. 2, 2014

(65) Prior Publication Data

US 2015/0360291 A1 Dec. 17, 2015

Related U.S. Application Data

(62) Division of application No. 14/007,335, filed as application No. PCT/EP2012/055427 on Mar. 27, 2012, now abandoned.

(60) Provisional application No. 61/468,445, filed on Mar. 28, 2011.

(30) Foreign Application Priority Data

Mar. 28, 2011 (GB) ..... 1105150.5

(51) Int. Cl.

| | |
|---|---|
| ***B22F 3/24*** | (2006.01) |
| ***C22C 29/08*** | (2006.01) |
| ***B22F 7/00*** | (2006.01) |
| ***C22C 29/00*** | (2006.01) |
| ***C22C 29/06*** | (2006.01) |
| *B22F 5/00* | (2006.01) |

(52) U.S. Cl.

CPC ... *B22F 3/24* (2013.01); *B22F 7/00* (2013.01); *B22F 7/008* (2013.01); *C22C 29/005* (2013.01); *C22C 29/067* (2013.01); *C22C 29/08* (2013.01); *B22F 2003/248* (2013.01); *B22F 2005/001* (2013.01); *B22F 2301/15* (2013.01); *B22F 2302/10* (2013.01)

(58) Field of Classification Search

CPC ..... B22F 3/24

See application file for complete search history.

(56) References Cited

U.S. PATENT DOCUMENTS

| | | | | |
|---|---|---|---|---|
| 3,451,791 | A | 6/1969 | Meadows | |
| 5,609,447 | A | 3/1997 | Britzke et al. | |
| 7,544,410 | B2 * | 6/2009 | Lengauer | B22F 3/101 427/255.11 |
| 2004/0141867 | A1 | 7/2004 | Dreyer et al. | |
| 2006/0093859 | A1 | 5/2006 | Konyashin et al. | |
| 2011/0116963 | A1 * | 5/2011 | Fang | B22F 3/1017 419/18 |
| 2014/0023546 | A1 | 1/2014 | Konyashin et al. | |

FOREIGN PATENT DOCUMENTS

| | | | |
|---|---|---|---|
| JP | 49041208 | A | 4/1974 |
| JP | 59133346 | A | 7/1984 |
| JP | 05230588 | A | 9/1993 |
| JP | 06192782 | A | 7/1994 |

OTHER PUBLICATIONS

Konyashin et al., "Novel ultra-coarse hardmetal grades with reinforced binder for mining and construction", International Journal of Refractory Metals & Hard Materials, Jul. 1, 2005, pp. 225-232, vol. 23, No. 4-6, Elsevier Ltd.

Konyashin et al., "Hardmetals with nanograin reinforced binder: Binder fine structure and hardness", International Journal of Refractory Metals & Hard Materials, Nov. 1, 2008, pp. 583-588, vol. 26, No. 6, Elsevier Ltd.

United Kingdom Patent Application No. 1105150.5, Search and Examination Reports, mailed Jul. 7, 2011, 5 pages.

United Kingdom Patent Application No. 1205370.8, Combined Search and Examination Report, mailed Jul. 10, 2012, 7 pages.

International Patent Application No. PCT/EP2012/055427, International Search Report and Written Opinion, mailed Aug. 1, 2012, 9 pages.

* cited by examiner

*Primary Examiner* — George Wyszomierski
*Assistant Examiner* — Ngoclan T Mai
(74) *Attorney, Agent, or Firm* — Dean W. Russell; Clark F. Weight; Kilpatrick Townsend & Stockton LLP

(57) ABSTRACT

Cemented carbide material comprising tungsten carbide (WC) material in particulate form having a mean grain size D in terms of equivalent circle diameter of at least 0.5 microns and at most 10 microns, and a binder phase comprising cobalt (Co) of at least 5 weight per cent and at most 12 weight per cent, W being present in the binder at a content of at least 10 weight per cent of the binder material; the content of the WC material being at least 75 weight per cent and at most 95 weight per cent; and nanoparticles dispersed in the binder material, the nanoparticles comprising material according to the formula CoxWyCz, where X is a value in the range from 1 to 7, Y is a value in the range from 1 to 10 and Z is a value in the range from 0 to 4; the nanoparticles having a mean particle size at most 10 nm, at least 10 per cent of the nanoparticles having size of at most 5 nm; the cemented carbide material having a magnetic coercive force in the units kA/m of at least −2.1XD+14.

9 Claims, 2 Drawing Sheets

CEMENTED CARBIDE MATERIAL

CROSS REFERENCE TO RELATED APPLICATIONS

Figure 1:
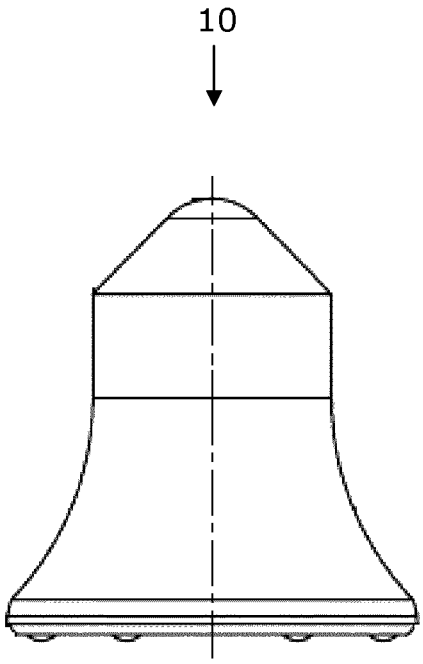

This application is a divisional of U.S. patent application Ser. No. 14/007,335 filed on Sep. 25, 2013, now abandoned which is the U.S. national phase of International Application No. PCT/EP2012/055427 filed on Mar. 27, 2012, and published in English on Oct. 4, 2012 as International Publication No. WO 2012/130851 Al, which application claims priority to Great Britain patent application Ser. No. 1105150.5 filed on Mar. 28, 2011 and U.S. Provisional Application No. 61/468,445 filed on Mar. 28, 2011, the contents of all of which are incorporated herein by reference.

This disclosure relates generally to cemented carbide material, tools comprising same and method for making same.

Cemented carbide material comprises particles of metal carbide such as tungsten carbide (WC) or titanium carbide (TiC) dispersed within a binder material comprising a metal such as cobalt (Co), nickel (Ni) or metal alloy. The binder phase may be said to cement the carbide particles together as a sintered compact. Measurements of magnetic properties may be used to measure indirectly aspects of the microstructure and properties of cemented carbide materials. The magnetic coercive force (or simply coercive force or coercivity) and magnetic moment (or magnetic saturation) can be used for such purposes.

European patent number 1 043 415 discloses a coated cemented carbide insert with a 5-50 micron thick, essentially gamma phase free and binder phase enriched surface zone with an average binder phase content (by volume) in the range 1.2-2.0 times the bulk binder phase content. The gamma phase consists essentially of TaC and TiC and to some extent of WC dissolved into the gamma phase during sintering. The ratio Ta/Ti is between 1.0 and 4.0.

Jonsson (Jonsson, H., 1981, "Microstructure and hardness of heat treated Co—W alloys with compositions close to those of binder phases of Co—WC cemented carbides", PhD thesis, Chemistry Institute of the University of Uppsala) discloses that ageing of homogenised Co—25% W alloys in the temperature range 500 to 800 degrees centigrade for at least up to about 100 hours is accompanied by an increase in hardness.

Cemented carbide materials are relatively wear- and fracture resistant. However, controlling the composition to increase the wear resistance may typically be expected to result in compromised fracture resistance, and vice versa. While heat treatment of cemented carbide materials for extended periods of time may be used to alter its properties, this reduces the speed of production and tends to increase cost.

Viewed from a first aspect, there can be provided cemented carbide material comprising tungsten carbide (WC) material in particulate form having a mean grain size D in terms of equivalent circle diameter of at least about 0.5 microns and at most about 10 microns (as measured using an electron backscatter diffraction image of a polished surface of the cemented carbide material), and a binder phase comprising cobalt (Co) of at least about 5 weight per cent and at most about 12 weight per cent; the content of the WC material being at least about 75 weight per cent and at most about 95 weight per cent; and nanoparticles dispersed in the binder material, the nanoparticles comprising material according to the formula CoxWyCz, where X is a value in the range from 1 to 7, Y is a value in the range from 1 to 10 and Z is a value in the range from 0 to 4 or Z is a value in the range from 1 to 4; the nanoparticles having a mean particle size at most about 10 nm, at least about 10 per cent of the nanoparticles having size of at most about 5 nm; the cemented carbide material having a magnetic coercive force in the units kA/m of at least about $-2.1\times D+14$. The mean grain size D is the number average of grain sizes d, expressed as the equivalent circle diameters of grains evident in an electron backscatter diffraction image of a polished surface of a body comprising the cemented carbide material.

Various examples of cemented carbide material are envisaged by this disclosure and the following are non-limiting, non-exhaustive examples.

W may be present in the binder at a content of at least about 10 weight per cent of the binder material. The W may be present in the binder in the form of solid solution or dispersed particles.

The binder phase may comprises iron (Fe) or nickel (Ni) or an alloy including Fe or Ni.

The Co content may be at least about 5 weight per cent and at most about 8 weight per cent and the cemented carbide material may have a magnetic coercive force in the units kA/m of at least about $-1.9\times D+14$.

The Co content is at least about 8 weight per cent and at most about 12 weight per cent and the cemented carbide material has a magnetic coercive force in the units kA/m of at least about $-2.1\times D+14$.

Viewed from a second aspect there is provided a method for making a cemented carbide body (i.e. a body comprising cemented carbide material), the method including providing a sintered body comprising tungsten carbide (WC) particles and a binder material comprising cobalt (Co), the WC particles having mean size D of at least about 0.5 microns and at most about 10 microns, the content of the WC particles in the sintered body being at least about 75 weight percent and at most about 95 weight percent, and the content of the binder material in the sintered body being at least about 5 weight percent and at most about 20 weight percent; and heat treating the sintered body at a temperature in the range from about 500 degrees centigrade to about 900 degrees centigrade for a period of time; the period in hours being at least about $(0.8\times D)-0.15$ and at most about $(4.3\times D)-1.7$.

W may be present in the binder at a content of at least about 10 weight per cent of the binder material. The W may be present in the binder in the form of solid solution or dispersed particles. The dispersed particles may comprise a compound according to the formula CoxWyCz, where X is a value in the range from 1 to 7, Y is a value in the range from 1 to 10 and Z is a value in the range from 0 to 4, or Z is a value in the range from 1 to 4.

The binder of the sintered body may comprise iron (Fe) or (Ni), or an alloy including at least one of Fe or Ni.

The composition and microstructure of the sintered body may be selected such that magnetic moment (or magnetic saturation) of the sintered body is at least about 70 per cent and at most about 85 per cent of the theoretical value of binder material comprising nominally pure Co or of the alloy of Co and Ni comprised in the binder material.

Viewed from a third aspect there is provided a tool or tool element comprising cemented carbide material according to this disclosure. The tool; may be a pick for road planning or mining. The tool may comprise a super hard tip joined to a support body comprising cemented carbide material according to this disclosure.

Disclosed cemented carbide material and bodies comprising same may have the aspect of exhibiting enhanced fracture resistance in combination with high wear resistance and or hardness. The disclosed method may have the aspect of reduced manufacturing time and enhanced manufacturing efficiency.

While wishing not to be bound by a particular theory, cemented carbide material comprising relatively small carbide particles having mean size of at most about 10 microns and present at a sufficiently high content of at least about 80 weight per cent (i.e. the content of the binder material is at most about 20 weight per cent) is likely to exhibit relatively small mean free path between the carbide particles and relatively thin inter-layers of binder material between them. This may have the consequence that the binder material has relatively high internal strain, which may have the effect that reduced ageing times are required to provide material having the desired combination of hardness and fracture resistance. If the content of the binder material is substantially greater than 20 weight per cent and or the mean size of the carbide particles is substantially greater than about 10 microns, then reduction of the aging time may result in reduced hardness and or reduced strength of the cemented carbide material. The precipitation of nanoparticles may have the effect of enhancing the erosion and other wear resistance of the cemented carbide material without substantially compromising the resistance to fracture or the strength.

Figure 2:
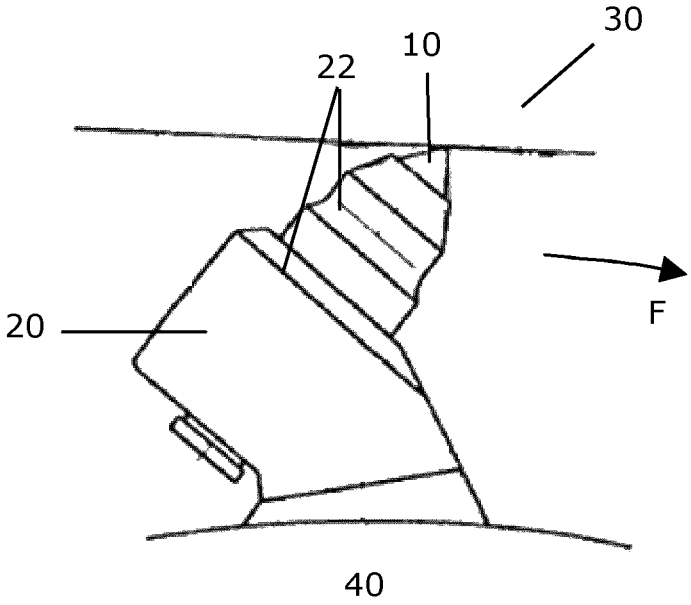
Figure 3:
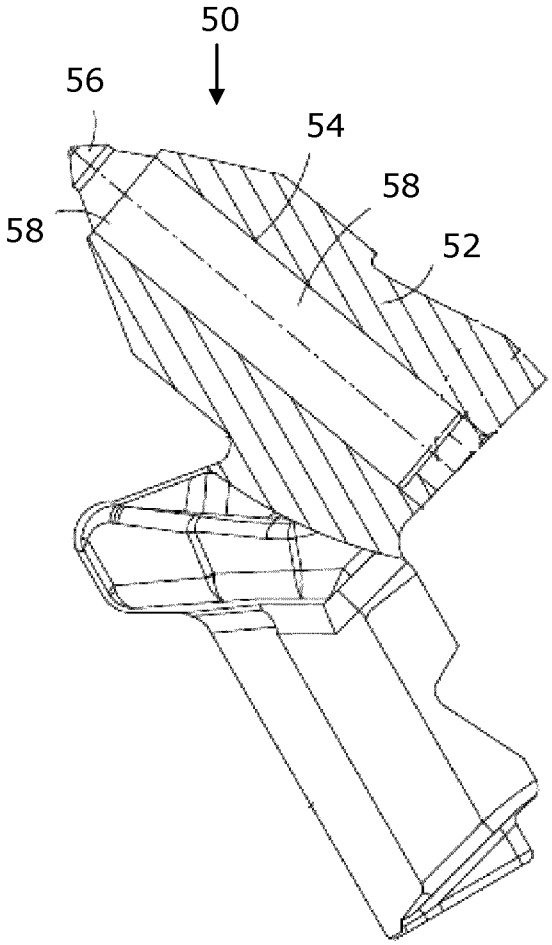

Non-limiting examples will be described with reference to the accompanying drawings, of which FIG. 1 shows a side view of an example tip for a pick for road planning (also referred to as road milling, pavement degradation or asphalt recycling);

FIG. 2 shows a side view of an example pick mounted on a drum and engaging a body; and FIG. 3 shows a partially cut away side view of an example pick.

With reference to FIG. 1, an example tip for road planning consists substantially of cemented tungsten carbide material according to this disclosure.

FIG. 2 illustrates an example pick 20 for road planning or mining, mounted on a drum 40 and engaging a formation 30. The pick comprises a holder system 22 and cemented carbide tip 10 and is driven in the general direction F in use.

FIG. 3 illustrates an example pick 50 comprising a holder 52 having a bore 54, and an insert comprising a polycrystalline diamond (PCD) tip 56 joined to a support body 58 comprising cemented carbide material disclosed and shrink-fitted into the holder 52.

Example cemented carbide material may comprise WC particles and a Co binder, and may have magnetic moment a (in units of micro-Tesla times cubic meter per kilogram) of at least 0.11×[Co] and at most 0.137×[Co], where [Co] is the weight per cent content of Co in the cemented carbide material. The concentration of tungsten [W] dissolved in the binder material, expressed as weight per cent of the binder material, may be at least about $(16.1-\sigma_B)/0.275$, where $\sigma_B$ is the magnetic moment of the binder material, obtained by dividing the magnetic moment σ of the cemented carbide material by the weight percentage of the binder material in the cemented carbide, which is equal to [Co] in examples where the binder material consists essentially of Co.

Example cemented carbide material may be substantially devoid of eta-phase, which may have the aspect of enhancing the strength and fracture resistance of the cemented carbide material. An eta-phase compound has the formula Mx M'y Cz, where M is at least one element selected from the group consisting of W, Mo, Ti, Cr, V, Ta, Hf, Zr, and Nb; M' is at least one element selected from the group consisting of Fe, Co, Ni, and C is carbon. Where M is tungsten (N) and M' is cobalt (Co), eta-phase is understood herein to mean Co3W3C (eta-1) or Co6W6C (eta-2), as well as fractional sub- and super-stoichiometric variations thereof. There are also some other phases in the W—Co—C system, such as theta-phases Co3W6C2, Co4W4C and Co2W4C, as well as kappa-phases Co3W9C4 and CoW3C (these phases are sometimes grouped in the literature within a broader designation of eta-phase). Particles comprising Co3W3C, Co6W6C and or theta phase Co2W4C in the face-centred cubic (fcc) crystallographic structure may be dispersed in the binder and have respective mean sizes of about 0.213 nm, 0.209 nm and 0.215 nm. The presence of these nanoparticles can be detected by means of electron diffraction patterns using transmission electron microscopy (TEM). Using dark field TEM, the nano-particles can be seen as dark spots. The presence of the nanoparticles within the binder may have the effect of reinforcing the binder.

Cemented carbide materials may have various compositions. In some examples, the cemented carbide material may contain at least about 0.1 weight per cent to about 10 weight per cent vanadium (V), chromium (Cr), tantalum (Ta), titanium (Ti), molybdenum (Mo), niobium (Nb) and or hafnium (Hf), which may be in the form of a solid solution in the binder material and or in the carbide form. Nanoparticles dispersed in the binder material may comprise V, Cr, Ta, Ti, Mo, Nb and or Hf. In some examples, the cemented carbide may contain at least 0.01 weight per cent and at most 5 weight per cent of one or more metals selected from Ru, Rh, Pd, Re, Os, In, and or Pt. Nanoparticles dispersed in the binder material may comprise Ru, Rh, Pd, Re, Os, In and or Pt.

Example cemented carbide material may contain diamond of cubic boron nitride (cBN) particles. The diamond or cBN particles may be present at 3 volume per cent to 60 volume per cent and may be provided with coating comprising a carbide, carbonitride and or nitride compound of Ti, Ta, Nb, W, Mo, V, Zr, Hf and or Si.

In example cemented carbide materials, the nanoparticles may be coherent with the crystal lattice of the binder material and or the nanoparticles may at least partly have a cubic crystal lattice structure.

In one version of an example method for making cemented carbide material, the sintered body may be provided by a method including milling WC powder with Co powder (and optionally other metals or their carbides, nitrides and or carbo-nitrides) to form a mixture, the powders selected to provide the mixture having equivalent total carbon content in the range from about 5.70 weight per cent to about 6.05 weight per cent; compacting the mixture to form a green body; sintering the green body at a temperature in the range from about 1,350 degrees centigrade to about 1,500 degrees centigrade and providing a sintered body having a magnetic saturation in the range from about 70 per cent to about 82 of the theoretical value of that of nominally pure Co, i.e. 16.1 $\mu Tm^3/kg$. The equivalent total carbon (ETC) in a mixture is the content of carbon in the mixture, the content being in excess of the carbon included in WC, expressed as a proportion of carbon in the whole mixture. The WC powder may comprise WC particles having a mean size D of at least about 0.5 microns and at most about 10 microns. An organic binder material such as paraffin wax may be introduced into the mixture prior to compaction and the green body should be heat treated prior to sintering to remove binder material. The green body may be sintered in a vacuum and or in an atmosphere comprising inert gas such as argon (Ar), by means of a hot isostatic press (HIP), for example. The ratio [C]/[W] of the content of carbon present in the binder material [C] to the content of tungsten present in the binder material [W] will be less than 1 and the W content dissolved in the binder material of the sintered body may be at least about 10 weight per cent and may lie, for example, in the range from 11.7 weight per cent to 17.6 weight per cent of the binder material.

The amount of C and W dissolved in the binder material of the sintered body may be controlled in a number of ways, such as adding W to the starting powders, using non-stochiometric starting tungsten carbide powder, carburisation/decarburisation of the green body. The ratio of [C]/[W] may be very low, which may be expected to result in the precipitation of particles of eta phase compounds in the binder material during the step of sintering the green body.

In some versions of the method, the content of WC particles comprised in the sintered body may be at least about 80 weight per cent, at least about 85 weight per cent or at least about 90 weight per cent, and the content of the binder material may be at most about 25 weight per cent, at most about 20 weight per cent, at most about 15 weight per cent or at most about 10 weight per cent. In one version of the method, the WC particles may have a mean size of at least about 2 microns. In some versions of the method, the binder material may comprise iron (Fe) or (Ni), or an alloy including at least one of Fe or Ni, and or $Co_7Ni$.

In some versions of the method, the sintered body may have a magnetic moment (or magnetic saturation) of at least about 70 per cent and or at most about 85 per cent of the theoretical value of binder material comprising nominally pure Co or an alloy of Co and Ni, as the case may be. So for example, where the binder consists substantially of Co, the sintered body may have a magnetic saturation of at least about $0.7\times201.9\ \mu T.m^3/kg=141\ \mu T.m^3/kg$; and at most about $0.85\times201.9\ \mu T.m^3/kg=172\ \mu T.\ m^3/$.

The sintered body may be heat treated at a temperature in the range from about 500 degrees centigrade to about 900 degrees centigrade for a period of time; the period in hours being at least about $(0.8\times D)-0.15$ and at most about $(4.3\times D)-1.7$, to produce a body having a magnetic saturation at least 1 per cent less than that of the sintered body and a magnetic coercive force at least about 20 per cent greater than that of the sintered body. The substantial increase in the magnetic coercive force is expected to indicate the precipitation of nanoparticles comprising a non-magnetic material phase. Some versions of the method include heat treating the sintered body at a temperature of at least about 600 degrees centigrade and or at most about 800 degrees centigrade for the period of time.

A tool comprising cemented tungsten carbide material as disclosed can be provided, for example a tool for pavement degradation, road planing, asphalt recycling, road reconditioning or mining can be provided. The tool may also comprise polycrystalline diamond (PCD) material or polycrystalline cubic boron nitride (PCBN) material, and may be a cutter element for machining, boring into or degrading bodies comprising metal, asphalt, stone, rock, concrete or composite material.

For example, a tip for a pick may be provided, the tip comprising or consisting substantially of cemented carbide material as disclosed. A pick comprising the tip can be provided. A pick comprising a super-hard tip such as polycrystalline diamond (PCD) joined to a support body comprising cemented carbide material as disclosed can also be provided, the super-hard material having Vickers hardness of at least about 28 GPa. Wear parts, drill bits and machine tools comprising the disclosed cemented carbide material can also be provided.

As used herein in relation to grains or particles such as WC grains comprised in hard-metal material, the term "grain size" d refers to the sizes of the grains measured as follows. A surface of a body comprising the hard-metal material is prepared by polishing for investigation by means of electron backscatter diffraction (EBSD) and EBSD images of the surface are obtained by means of a high-resolution scanning electron microscope (HRSEM). Images of the surface in which the individual grains can be discerned are produced by this method and can be further analysed to provide the number distribution of the sizes d of the grains, for example. As used herein, no correction (e.g. Saltykov correction) is applied to correct the grain sizes to account for the fact that they were obtained from a two dimensional image in this way. The grain size is expressed in terms of equivalent circle diameter (ECD) according to the ISO FDIS 13067 standard. The ECD is obtained by measuring of the area A of individual grains exposed at the surface and calculating the diameter of a circle that would have the same area A, according to the equation d=square root of $(4\times A/\pi)$. The method is described further in section 3.3.2 of ISO FDIS 13067 entitled "Microbeam analysis—Electron Backscatter Diffraction—Measurement of average grain size" (International Standards Organisation, Geneva, Switzerland, 2011). The mean grain size D of WC grains in cemented WC material is obtained by calculating the number average of the WC grain sizes d as obtained from the EBSD images of the surface. The EBSD method of measuring the sizes of the grains has the significant advantage that each individual grain can be discerned, in contrast to certain other methods in which it may be difficult or impossible to discern individual grains from agglomerations of grains. In other words, certain other methods may be likely to give false higher values for grain size measurements.

The amount of tungsten dissolved in cobalt-based binder material can be measured indirectly, by measurement of magnetic moment (or magnetic saturation) of cemented carbides because the magnetic saturation of Co decreases in inverse proportion to the content of tungsten in solution. The concentration of tungsten dissolved in the binder tends to be higher, the lower the total carbon content, so that the magnetic moment shows indirectly the total carbon content in cemented carbides.

The magnetic saturation Ms is proportional to $[C]/[VV]\times[Co]\times201.9$ in units of $\mu T.m^3/kg$, where [VV] and [C] are the concentrations of W and C, respectively, in the binder material and [Co] is the weight per cent of Co in the cemented carbide material. For example, the W concentration at low C contents is significantly higher. The magnetic saturation of a hard metal, of which cemented tungsten carbide is an example, is defined as the magnetic moment per unit weight, $\sigma$, as well as the induction of saturation per unit weight, $4\pi\sigma$. The magnetic moment, $\sigma$, of pure Co is 16.1 micro-Tesla times cubic metre per kilogram ($\mu T.m^3/kg$), and the magnetic saturation, $4\pi\sigma$, of pure Co is $201.9\ \mu T.m^3/kg$.

The content of Co in the binder material of cemented carbide material can be measured by various methods well known in the art, including indirect methods such as such as the magnetic properties of the cemented carbide material or more directly by means of energy-dispersive X-ray spectroscopy (EDX), or the most accurate method is based on chemical leaching of Co.

Non-limiting examples of cemented carbide material are described in more detail below.

EXAMPLE 1

Ultra-coarse WC powder with mean grain size (the Fischer number) of 40.8 microns (MAS3000-5000™ from H. C. Starck™, Germany) and super-stoichiometric carbon content of 6.12 weight percent was blended with about 9.7 weight percent Co powder and about 2 weight percent W metal powder. Both the W powder and the Co powder had a mean particle size of about 1 micron. The composition of the combined powders was therefore 88.3 weight percent WC (including the excess carbon), 9.7 weight percent Co and 2 weight percent W. The Equivalent Total Carbon (ETC) of the mixture with respect to WC was 6.0 weight percent. The powders were milled together for 10 hours by means of a ball mill in a milling medium comprising hexane with 2 weight percent paraffin wax, using a powder-to-ball ratio of 1:3. The powder was dried and green bodies for sintering bodies configured for carrying out transverse rupture strength (TRS) measurement according to the ISO 3327-1982 standard and wear-resistance measurement according to the ASTM B611-85 standard were prepared by compacting the powder mixture. The green bodies were sintered at 1,420 degrees centigrade for 75 minutes for produce sample sintered bodies. The sintering cycle including a 45 minute vacuum sintering stage and a 30 minute hot isostatic pressure (HIP) sintering stage carried out in an argon atmosphere at a pressure of 40 bars.

Metallurgical cross-sections of some of the sample bodies were made for examination of the microstructure, the Vickers hardness, the micro-hardness and nano-hardness of the sample bodies. The binder nano-hardness was measured by means of add-on depth-sensing nano-indentation. Spatial and depth-resolved information about the micro-mechanical properties of the binder was measured by means of a nano-indentation device (Hysitron TriboScope™) mounted on a scanner head of an atomic force microscope (AFM) (Park Scientific Instruments, AutoProbe CPT™). The direct combination of the nano-indentation device with AFM allows imaging and indenting the surface with the tip, which enables the tip to be positioned for indentation with an accuracy of down to 20 nm. The measurements were carried out at a load of 500 micro-Newton using a Bercovich Indenter™. Transmission electron microscopy (TEM) and high-resolution TEM (HRTEM) studies of the binder were carried out on the JEOL-4000FX instrument.

The microstructure was found to comprise only WC and the binder material; no eta-phase or free carbon was found. The WC mean grain size obtained on the basis of the EBSD mapping images was about 3.1 microns.

The density of the cemented carbide was about 14.54 g/cm$^3$, the TRS was 2,050 MPa, the Vickers hardness (HV30) was 10.5 GPa, the magnetic coercive force was 4.8 kA/m (60 Oe), the magnetic moment a was 1.16 μT.m$^3$/kg, the magnetic saturation $4\pi\sigma$ was 14.6 μT.m$^3$/kg and the wear rate was $1.9\times10^{-4}$ cm$^3$/revolution. The nano-hardness of the binder material was 7.5 GPa. TEM images of the binder material indicated the presence of only the face-centred cubic (fcc) crystallographic structure of Co, indicating the substantial absence of nanoparticles in the binder material.

Some of the remaining sample bodies were heat-treated in a vacuum at 600 degrees centigrade for 10 hours, following which these samples were analysed as described above. The appearance of the microstructure of the cemented carbide under visible light had not substantially changed. The TRS of the of the heat treated cemented carbide material had increased substantially to 3,200 MPa, the Vickers hardness (HV30) had increased to 11.5 GPa, the magnetic coercive force had increased substantially to 13.4 kA/m (168 Oe), the magnetic moment a was 1.11 μT.m$^3$/kg, the correspondingly magnetic saturation $4\pi\sigma$ was 13.9 μT m$^3$/kg and the wear rate had decreased substantially to $0.6\times10^{-4}$ cm$^3$/revolution. The nano-hardness of the binder had increased to 10.2 GPa. Therefore, the wear resistance (the ASTM B611 test) of the cemented carbide with the binder comprising the nanoparticles was found to be higher than that with that without nanoparticles by about 40%. As a result of the heat-treatment, the magnetic moment had noticeably decreased (by about 4 percent) and the magnetic coercive force had significantly increased (by a factor of nearly 2.8), providing evidence for the precipitation of nanoparticles consisting of a non-magnetic phase in the binder material. This seems to have resulted in a dramatic increase of nano-hardness of the binder material and significantly higher hardness and improved wear resistance of the cemented carbide material. The strength (TRS) of the cemented carbide material had also significantly increased after the heat-treatment.

TEM images of the binder material indicated the presence of reflections from fcc Co and satellite reflections corresponding to the nanoparticles. The dark field TEM image of the binder material obtained using the satellite reflections indicated the presence of nanoparticles having size in the range from about 0.5 to about 7 nm. The mean grain size of the nanoparticles is measured by the linear intercept method and was found to be equal to 3.1 nm and the percentage of nanoparticles having size less than 3 nm was found to be 39 per cent. The nanoparticles are believed to correspond to eta-(Co3W3C or Co6W6C) or theta-phases (Co2W4C). Although the crystal lattice of these phases is very similar, the inter-lattice constant corresponded more closely to that of the theta-phase the best of all.

EXAMPLE 2

A sample body was prepared as described in Example 1, except that the WC powder was blended with about 6.2 weight percent Co powder and about 2 weight percent W metal powder.

EXAMPLES 3 TO 11

Sample bodies comprising a different grade of cemented carbide material were made, in which the WC had a mean grain size of about 1 micron and the content of Co was about 13 weight percent. These bodies were heat treated at temperatures from 600 degrees centigrade to 800 degrees centigrade for various periods of time from 0.5 hour, 1 hour and 2 hours as shown in table 1 below. The density, magnetic saturation and magnetic coercive force of the sintered body were measured before ageing and after ageing. Before ageing, the density of the sintered bodies was 14.3 g/cm$^3$, the magnetic saturation was 16.2 G.cm$^3$/g and the magnetic coercive force was 144 Oe. The table below also shows the respective density, magnetic saturation, magnetic coercive force and Vickers hardness for each of the sample bodies aged at different conditions.

TABLE 1

| Example | Ageing temperature, degrees centigrade | Ageing time, hours | Magnetic saturation, G · cm$^3$/g | Magnetic coercive force, Oe |
|---|---|---|---|---|
| 3 | 600 | 1 | 15.6 | 261 |
| 4 | 600 | 2 | 15.5 | 286 |
| 5 | 680 | 1 | 15.7 | 207 |
| 6 | 680 | 2 | 15.7 | 209 |
| 7 | 750 | 0.5 | 15.4 | 190 |
| 8 | 750 | 1 | 15.7 | 152 |
| 9 | 800 | 0.5 | 15.5 | 159 |
| 10 | 800 | 1 | 15.8 | 155 |
| 11 | 800 | 2 | 15.9 | 151 |

In order to observe the effect of longer aging periods, samples of the material were heat treated for cumulative periods of 5 hours and 10 hours at each of 600 degrees centigrade, 680 degrees centigrade and 800 degrees centigrade, and these results are shown in table 2 below.

TABLE 2

| For comparison with Example | Ageing temperature, degrees centigrade | Ageing time, hours | Magnetic saturation, $G \cdot cm^3/g$ | Magnetic coercive force, Oe |
|---|---|---|---|---|
| 3 and 4 | 600 | 5 | 15.4 | 270 |
| 3 and 4 | 600 | 10 | 15.4 | 297 |
| 5 and 6 | 680 | 5 | 15.6 | 203 |
| 6 and 7 | 680 | 10 | 15.6 | 195 |
| 9, 10 and 11 | 800 | 5 | 15.8 | 142 |
| 9, 10 and 11 | 800 | 10 | 15.9 | 139 |

The magnetic coercive force increased substantially after just 0.5 hours of ageing at 600 degrees centigrade, indicating the precipitation of highly dispersed particulates in the binder material. However, the further ageing did not result in substantially further increase in magnetic coercive force.

Various example embodiments of pick tools and methods for assembling and connecting them have been described above. Those skilled in the art will understand that changes and modifications may be made to those examples without departing from the scope of the claimed invention.

What is claimed is:

1. A method for manufacturing a cemented carbide body comprising cemented carbide material comprising tungsten carbide (WC) material in particulate form having a mean grain size D in terms of equivalent circle diameter of at least 0.5 microns and at most 10 microns, and a binder phase comprising cobalt (Co) of at least 5 weight per cent and at most 12 weight per cent; the method including providing a sintered body comprising tungsten carbide (WC) particles and a binder material comprising cobalt (Co), the WC particles having mean size D of at least 0.5 microns and at most 10 microns, the content of the WC particles in the sintered body being at least 75 weight percent and at most 95 weight percent, and the content of the binder material in the sintered body being at least 5 weight percent and at most 20 weight percent; and heat treating the sintered body at a temperature in the range from 500 degrees centigrade to 900 degrees centigrade for a period of time; the period in hours being at least $(0.8\times D)-0.15$ and at most $(4.3\times D)-1.7$.

2. A method as claimed in claim 1, in which the cemented carbide material comprises tungsten (W) present in the binder at a content of at least 10 weight per cent of the binder material; the content of the WC material being at least 75 weight per cent and at most 95 weight per cent; and nanoparticles dispersed in the binder material, the nanoparticles comprising material according to the formula CoxWyCz, where X is a value in the range from 1 to 7, Y is a value in the range from 1 to 10 and Z is a value in the range from 0 to 4; the nanoparticles having a mean particle size at most 10 nm, at least 10 per cent of the nanoparticles having size of at most 5 nm; the cemented carbide material having a magnetic coercive force in the units kA/m of at least $-2.1\times D+14$.

3. A method as claimed in claim 2, in which the Co content is at least 5 weight per cent and at most 8 weight per cent and the cemented carbide material has a magnetic coercive force in the units kA/m of at least $-1.9\times D+14$.

4. A method as claimed in claim 2, in which the Co content is at least 8 weight per cent and at most 12 weight per cent and the cemented carbide material has a magnetic coercive force in the units kA/m of at least $-2.1\times D+14$.

5. A method as claimed in claim 2, containing at least about 0.1 weight percent to about 10 weight percent vanadium (V), chromium (Cr), tantalum (Ta), titanium (Ti), molybdenum (Mo), niobium (Nb) and or hafnium (Hf).

6. A method as claimed in claim 2, in which the binder material contains at least 10 weight percent tungsten (W).

7. A method as claimed in claim 6, in which the W is present in the binder material in the form of solid solution or dispersed particles comprising a compound according to the formula CoxWyCz, where X is a value in the range from 1 to 7, Y is a value in the range from 1 to 10 and Z is a value in the range from 1 to 4.

8. A method as claimed claim 2, in which the binder of the sintered body comprises iron (Fe) or (Ni), or an alloy including at least one of Fe or Ni.

9. A method as claimed in claim 2, in which the composition and microstructure of the sintered body is selected such that magnetic moment (or magnetic saturation) of the sintered body is at least about 70 percent and at most about 85 percent of the theoretical value of binder material comprising nominally pure Co or of the alloy of Co and Ni comprised in the binder material.

* * * * *